United States Patent [19]
Swain et al.
[11] 4,317,528
[45] Mar. 2, 1982

[54] FLOATING ROOF TANK SEALING METHODS AND APPARATUS

[75] Inventors: Fredrick O. Swain, La Canada-Flintridge; Raymond E. Decker, Riverside, both of Calif.

[73] Assignee: Mesa Industries, Inc., Monrovia, Calif.

[21] Appl. No.: 68,856

[22] Filed: Aug. 21, 1979

[51] Int. Cl.[3] ..... B65D 88/46
[52] U.S. Cl. ..... 220/224; 277/12
[58] Field of Search ..... 220/216, 221, 222, 224, 220/226; 277/12, 27

[56] References Cited

U.S. PATENT DOCUMENTS

| | | | |
|---|---|---|---|
| Re. 22,169 | 9/1942 | Hammeren . | |
| 1,673,983 | 6/1928 | Kuhl . | |
| 1,698,158 | 1/1929 | Glass . | |
| 2,180,587 | 11/1939 | Hammeren | 220/224 |
| 2,314,805 | 3/1943 | Wiggins | 220/222 |
| 2,318,134 | 5/1943 | Wiggins . | |
| 2,327,083 | 8/1943 | Wiggins . | |
| 2,329,965 | 9/1943 | Wiggins . | |
| 2,329,966 | 9/1943 | Wiggins . | |
| 2,354,629 | 7/1944 | Wiggins | 220/224 |
| 2,522,254 | 9/1950 | Wiggins . | |
| 2,542,444 | 2/1951 | Wilkin | 220/224 |
| 3,167,206 | 1/1965 | Nelson . | |
| 3,204,809 | 9/1965 | Cadwell | 220/222 |
| 3,398,851 | 8/1968 | Challenger | 220/224 |
| 3,422,981 | 1/1969 | McBrien | 220/224 |
| 3,795,339 | 3/1974 | Barbier . | |
| 4,138,032 | 2/1979 | McCabe | 220/224 |

FOREIGN PATENT DOCUMENTS

| | | | |
|---|---|---|---|
| 1277238 | 3/1962 | France . | |
| 5213 | of 1912 | United Kingdom | 220/224 |

*Primary Examiner*—Allan N. Shoap
*Attorney, Agent, or Firm*—Benoit Law Corporation

[57] ABSTRACT

A seal is attached to and curved around a floating roof of a storage tank for petroleum products or other liquid materials, to extend to an outer circumference at the tank wall. The curved seal is suspended at first suspension points on the seal spaced about the floating roof. These first suspension points are spaced from the mentioned outer circumference at the wall by a first distance greater than zero and from the floating roof at a second distance greater than such first distance. The curved seal is suspended at these first suspension points from a series of corresponding second suspension points spaced from the first suspension points by third distances. Each of the second suspension points is spaced from the tank wall by a fourth distance greater than zero and from a peripheral cylindrical reference surface about the floating roof by a fifth distance greater than the mentioned fourth distance. The lengths of the fourth and fifth distances are varied in response to fluctuations of the varying width between the floating roof and the tank wall. The ratio of the fourth width to the fifth width is maintained constant during fluctuations of the latter varying width.

15 Claims, 3 Drawing Figures

FLOATING ROOF TANK SEALING METHODS AND APPARATUS

BACKGROUND OF THE INVENTION

1. Field of the Invention

The subject invention relates to sealing systems, to floating roof tanks for storing petroleum products or other liquids, to improved sealing systems for a floating roof, to curved seal suspension methods, and to primary seal inspection methods in floating roof systems equipped with primary and secondary seals.

2. Disclosure Statement

This disclosure statement is made pursuant to the duty of disclosure imposed by law and formulated in 37 CFR 1.56(a). No representation is hereby made that information thus disclosed in fact constitutes prior-art inasmuch as 37 CFR 1.56(a) relies on a materiality concept which depends on uncertain and inevitably subjective elements of substantial likelihood and reasonableness, and inasmuch as a growing attitude appears to require citation of material which might lead to a discovery of pertinent material though not necessarily being of itself pertinent.

A floating roof storage tank has a clearance or annular space between the floating roof and the wall of the tank to permit practically unrestrained vertical travel of the roof floating on the liquid stored in the tank. Increasing environmental and economic concerns call for a stricter prevention of vapor escape through the floating roof clearance from petroleum products or other volatile liquids stored in the tank.

In practice, several factors promote, rather than prevent, an escape of vapor from the tank. For one thing, the clearance around the floating roof in the storage tank has to be sufficiently wide to accommodate out-of-roundness and other local dimensional variations in the circularity of the floating roof and tank, caused by such factors as fabrication and erection tolerances, uneven foundation settlements, and directional mechanical or thermal loads, such as the loads caused by high winds and diurnal solar exposure. Such exposure, incidentally, also raises the temperature of the stored liquid, thereby promoting an escape of vapor through the annular clearance.

Unidirectional loads, including high winds, also tend to drive the floating roof on top of the stored liquid, thereby subjecting the width of the annular clearance between the floating roof and the tank to wide variations, while exposing the floating roof to the danger of contact and collision with the tank wall.

Further sealing problems are caused by the propensity of stored liquids and their residues to form crusts and other intractable deposits on the inside of the tank wall.

In the face of these countervailing requirements and difficulties, attempts have been made over more than half a century to solve the underlying problems and satisfy the above mentioned increasing environmental and economic needs.

A recent representative of these efforts is U.S. Pat. No. 4,138,032, by John S. McCabe, issued Feb. 6, 1979, for Full Secondary Seal, Wiper Type, for a Floating Roof Tank, and herewith incorporated by reference herein. That patent follows the now classical approach of providing a secondary seal, mounted at the top of the floating roof, in addition to a primary seal extending around the circumference of the floating roof. According to the approach pursued in that patent, flexible resilient elongated stiffeners are embedded in the elastomeric material of a curved wiper type secondary seal.

According to that cited patent, the reinforced elastomeric seal not only flexes in a vertical arc as the floating roof moves toward and away from any adjoining tank wall portion, but that circumferential stretching and contracting of the seal strip at its outside periphery is unrestrained by the stiffeness, thereby permitting the strip to contact and accommodate to the contour and spacing of the tank wall from the roof edge.

As the cited patent points out, the composite sealing strip therein disclosed, after installation on a floating roof, can acquire an upwardly or downwardly curved or bent shape or a partially upwardly and partially downwardly curved or bent shape as shown in FIGS. 1, 3 and 4 of the cited patent. In practice, the above mentioned problem, including a considerably varying width of the clearance between the tank wall and floating roof and the coarseness and contamination of the inside tank wall, tend to cause curved seals of the type just described to flip over or otherwise loose their efficacy, especially when the floating roof reverses its direction of movement in the operation of the storage tank.

In this respect, the secondary seal configuration shown in FIG. 3 of the cited patent would appear to promote a seepage of rain water or other contaminants into the tank between the circumference of the seal and the adjacent typically coarse tank wall portions. The secondary seal configuration shown in FIG. 4 of the cited patent, on the other hand, appears to display a tendency to act in the manner of a gutter for rain water and other contaminants, which might be disgorged into the storage tank if the seal were to reverse its position from the configuration shown in FIG. 4 to the opposite shape shown in FIG. 3 of the cited patent.

Also, a gradual separation of the elastomeric material from the embedded stiffeners has been noted in practice with some curved seals of the embedded stiffener type.

Reference should in this respect also be had to the patents and background cited in different portions of the above mentioned McCabe patent and herewith incorporated by reference herein.

In the curved secondary seal of the above mentioned U.S. Pat. No. 4,138,032, as well as in a similar seal in U.S. Pat. No. 1,698,158 and in the secondary seal of U.S. Pat. No. 3,167,206, internal or external spring fingers or stiffeners extend practically to the outer circumference of the curved seal at the tank wall. A similar principle may be observed with respect to mechanical linkages and mechanisms which in the past have been proposed for the purpose of retaining the seal at its outer circumference at the tank wall.

In particular, as may, for instance, be seen with reference to U.S. Pat. Nos. 1,673,983, 2,318,134, 2,327,083, 2,329,965, 2,329,966, 2,522,245 and Re. 22,169, previously proposed linkages and mechanisms engage or apply forces to the seal at points which are located in such proximity to the tank wall that the distance between the points of engagement or force application and the tank wall is practically zero. Moreover, these previous proposals couple the seal retaining devices or linkage to the hub of rollers riding along the inside wall of the tank, whereby the distance between such coupling and the tank wall remains constant, irrespective of width variations between the floating roof and the tank wall. Those approaches thus fail to accommodate the seal retention at the tank wall to the different needs brought about by different widths of the clearance between the floating and drifting roof and the inside of the tank wall.

A similar deficiency is observable with respect to those previous proposals which employ springs or resilient members for applying the seal or its retainer to the tank wall. In particular, with existing or previously proposed spring-biased mechanisms, the spring force tends to be weakest when the floating roof has drifted farthest from the tank wall, though the probability of vapor leakage from the storage tank and contaminant seepage into the tank through separation of the seal from the tank wall is greatest at that point.

Another system, in which sealing panels are located on inclined radial arms which retain such panels with intermediate lugs, is apparent from French Pat. No. 1.227.238, issued Oct. 16, 1961 to General American Transportation Corporation. It is, however, not seen how that system could solve the above mentioned problems and meet the above mentioned needs.

SUMMARY OF THE INVENTION

It is a general object of this invention to overcome the disadvantages and satisfy the needs expressed or implicit in the above disclosure statement or in other parts hereof.

It is a germane object of this invention to provide improved liquid storage facilities.

It is a related object of this invention to provide improved storage tanks of the floating roof type.

It is also an object of this invention to provide improved sealing systems for floating roof tanks.

It is a further object of this invention to provide improved curved sealing structures.

It is also an object of this invention to provide improved inspection methods and means for floating roof tanks or other containers including primary and secondary seals.

Other objects of this invention will become apparent in the further course of this disclosure.

From a first aspect thereof the subject invention resides in a method of preventing vapor from escaping from a storage tank through an annular space of varying width between a floating roof in, and a wall of, said tank. The invention according to this aspect resides, more specifically, in the improvement comprising in combination the steps of closing said annular space with a corresponding annular flexible seal extending in the tank from the floating roof to an outer circumferenc at said wall for a width larger than the largest extent of said varying width, curving the seal around the floating roof and between the floating roof and said wall, applying to the curved seal at intervals spaced about the floating roof a series of forces each acting on the curved seal at a first distance from said outer circumference at said wall and at a second distance from the floating roof greater than the first distance, varying said forces in response to fluctuations of said varying width, and reversing said forces in response to diminution of said varying width.

From another aspect thereof, the subject invention resides in sealing apparatus for preventing vapor from escaping from a storage tank through an annular space of varying width between a floating roof in, and a wall of, said tank. The invention according to this aspect resides, more specifically, in the improvement comprising, in combination, means for closing said annular space including a corresponding annular flexible seal of a width larger than the largest extent of said varying width, means for curving the seal around the floating roof and between the floating roof and said wall, including means for mounting the seal of larger width on the floating roof to extend in the tank from the floating roof to an outer circumference at said wall, and means for applying to the curved seal at intervals spaced about the floating roof a series of forces each acting on the curved seal at a first distance from said outer circumference at said wall and at a second distance from the floating roof greater than the first distance, said force applying means including means for varying said forces in response to fluctuations of said varying width, said means for applying forces include means for suspending the curved seal at said intervals, and said means for applying forces include means for reversing the suspension of the curved seal in response to diminution of said varying width.

Other aspects of the inventin will be disclosed in the description of preferred embodiments.

BRIEF DESCRIPTION OF THE DRAWINGS

The subject invention and its various aspects and objects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
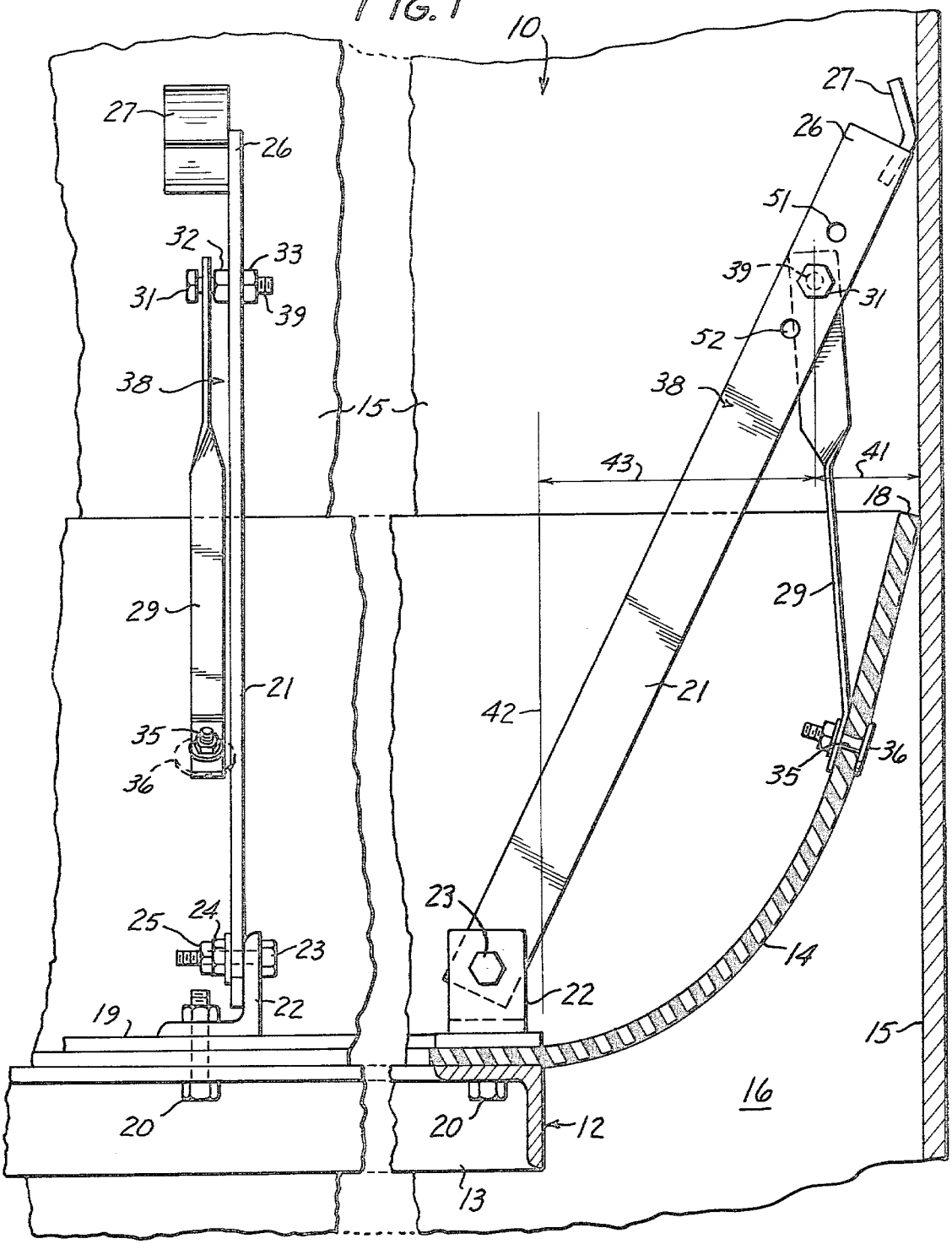
FIG. 1 is a foreshortened vertical sectional view through a fraction of a liquid tank and part of a floating roof, equipped with a sealing structure according to a preferred embodiment of the subject invention.
Figure 2:
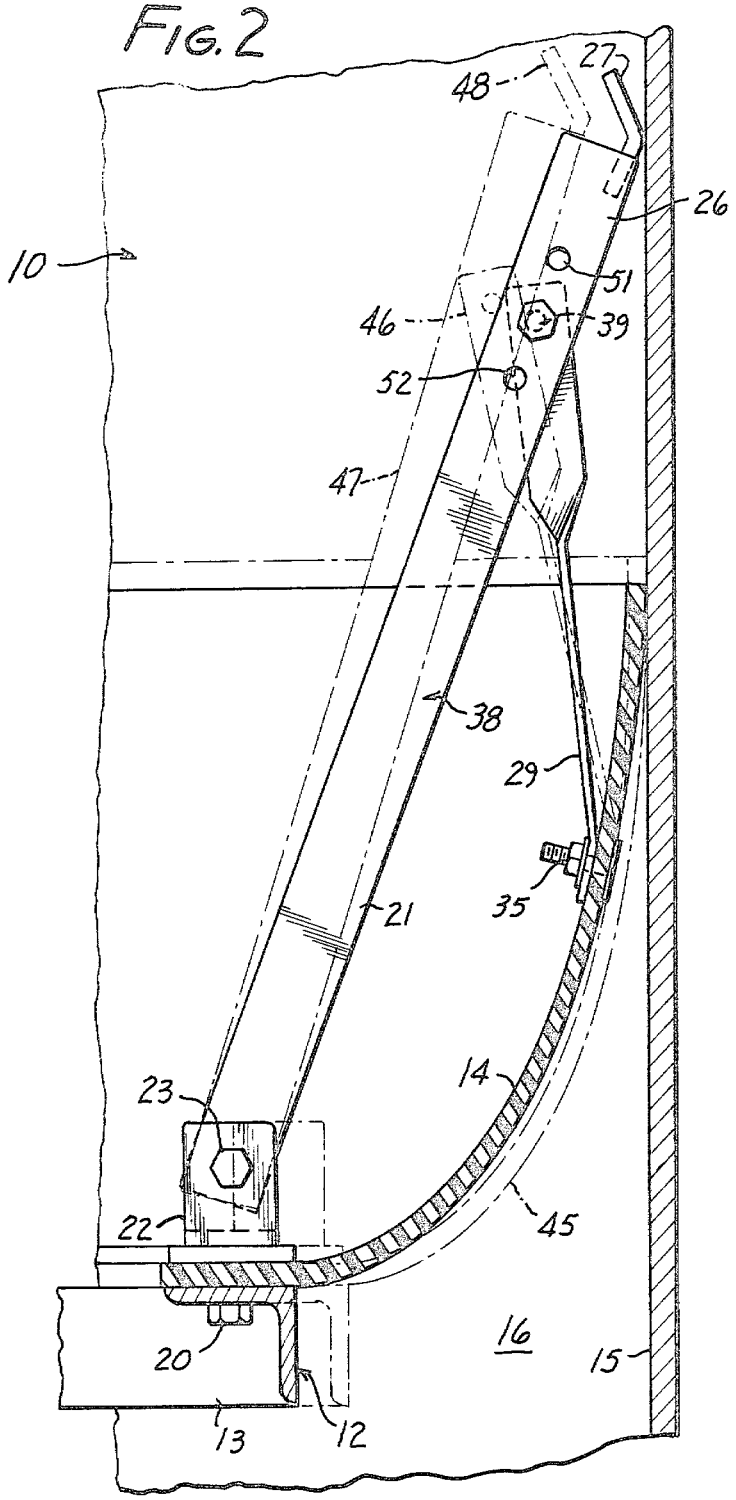
FIG. 2 is a view similar to the right-hand side of FIG. 1, showing the floating roof and sealing structure in different positions.
Figure 3:
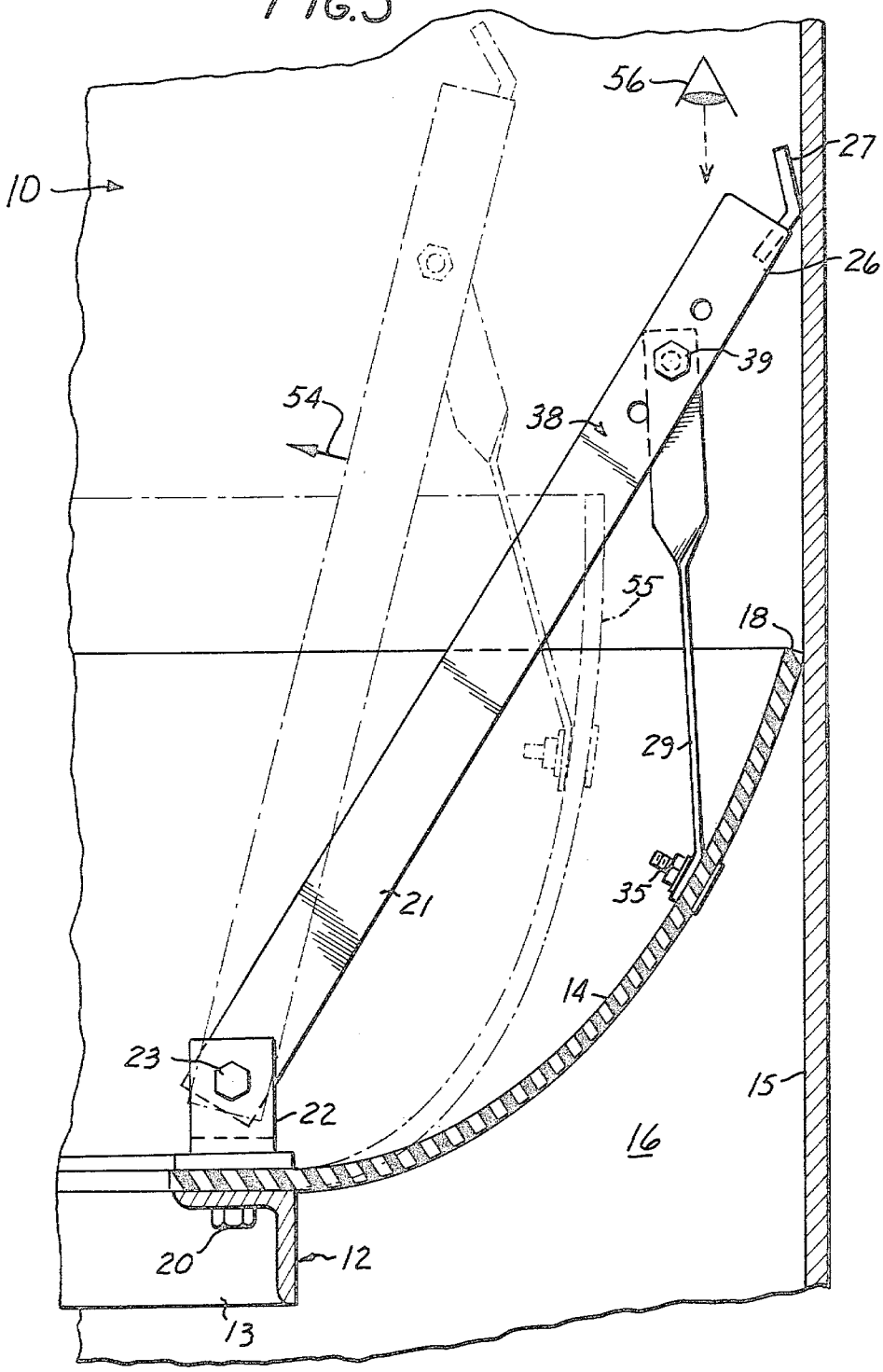
FIG. 3 is a view similar to the right-hand side, showing the floating roof and sealing structure in yet another position, and showing in phantom outline methods and means for inspecting a primary seal or other part of the tank structure.

The storage tank 10, part of which is seen in FIGS. 1 to 3, may be of the general type shown and described in the above mentioned McCabe U.S. Pat. No. 4,138,032 and in U.S. Pat. No. 3,795,339, by Claude Barbier, issued Mar. 5, 1974, for Seal Ring for a Floating Tank Roof. As shown in these patents, as well as in other references referred to above, the storage tank herein under consideration is of the type having a roof floating on the liquid being stored. Only part of the floating roof structure 12 is shown in the drawings. In particular, FIGS. 1 to 3 symbolize the floating roof by the showing of one its components in the form of an angle iron 13. The floating roof of the illustrated preferred embodiment may have any of the structures shown in the above mentioned patents or references, such as the floating roof structure 12 shown and described in the above mentioned, incorporated McCabe patent.

The curved seal 14 shown in the drawings corresponds to the secondary seal 30 shown in the cited McCabe patent.

Though not shown in the drawings, the tank structure according to the illustrated preferred embodiment also has a primary seal of the type shown in the above 14. As shown by way of example in the drawings, the link 29 to this end has a midway twist so that its lower portion runs in a plane extending at an angle to the adjacent sector of the seal 14 and tank wall 15.

In response to diminution of the varying width of the annular interspace 16, the operation of the illustrated preferred embodiment selectively lifts the suspension device 38 off the tank wall 15. This is illustrated by phantom lines in FIG. 2.

In particular, phantom outlines 45, 46, 47 and 48 illustrate how the curved seal 45 acts through the link 29 in lifting the suspension devices 38 off the tank wall 15 as the width of the annular space 16 or the distance between adjacent portions of the floating roof 12 and tank wall 15 diminishes.

In this process, the pivoted end of the lever 21 remains, of course, coupled to the floating roof via bracket 22 and the angle between the lever 21 and link 29 becomes more acute. This, in practice, places a limit on the extent by which the seal 14 can ride up on the tank wall 15. The suspension devices 38 according to an embodiment of the subject invention thus perform the added function of exerting a centering action on the floating roof within the tank 10. Collision between the floating roof and the tank wall 15 and damage to the tank wall or tilting of the roof are thus advantageously avoided.

A somewhat different but at least equally beneficial function is provided by the suspension devices 38 when the floating roof drifts away from the tank wall in any region of the storage tank. This is illustrated with the aid of FIG. 3.

In contrast to the situation shown in FIG. 2, where the suspension forces are reversed in response to diminution of the varying width of the annular clearance 16, the suspension provided by the devices 38 becomes most significant as the clearance 16 is approaching its maximum possible width.

In that case, the curved seal 14 is particularly vulnerable to being caught at the wall 15, as its outer circumference 18 is then exposed to a particular tendency to dig into coarse residues at the tank wall 15. If a drifting away of the floating roof 12 from the tank wall 15 in a particular tank region is accompanied by an upward movement of the floating roof, the curved seal 14 is in particular danger of being flipped over or being subject to another detrimental variation of its preferable configuration.

The subject invention and its preferred embodiments effectively prevent such detrimental configuration variations and flipping over of the seal 15 by the operation of the suspension devices 38 or their functional equivalence within the scope of the subject invention.

As the lever 12 goes through its motions between the extreme positions shown in FIGS. 2 and 3 and via the midposition shown in FIG. 1, the lever 21 or each longitudinal edge thereof acts as a generatrix of a parabolic curve similar to an average curvature of the seal 14.

As already mentioned above, the seal 14 preferably is flexibly connected to the levers 21 at the suspension points 35. However, unlike prior proposals which employ helical springs, leaf springs, resilient rods or similar spring bias means, the subject invention in its illustrated embodiment employs the resiliency of the elastic seal 14 as the only spring bias of any lever 21 via the flexible link 29.

In accordance with an embodiment of the subject invention, the second suspension points may be adjustable. For instance, further aperture 51 and 52 may be provided in the lever 21 for adjusting the second suspension point 39 longitudinally of the lever 21.

Unlike prior-art mechanisms, the lifting devices 38 not only are of very rugged and basically simple structure, but also are immune to damage from an over-riding of the upper rim of the tank wall. In particular, if the storage tank should accidentally reach an over-filled condition, the free lever ends 26 and shoes 27 simply ride over the top rim of the tank, to slide back onto the inside surface of the tank wall as liquid is removed from the tank structure.

Government regulations and good practice require that the sealing facilities of floating roof tanks be frequently inspected. In the case of tanks equipped with primary and secondary seals, this requires that the secondary seal, located above the primary seal as seen from the top of the floating roof, be lifted away from the tank wall 15 for a visual inspection of the primary seal or adjacent structural portions of the storage tank. Heretofore, it was rather difficult for the inspector to effect a selective removal of the seal from the tank wall. Often, the use of instruments exposing the secondary seal to damage was necessary.

According to the preferred embodiment of the subject invention, the suspension devices 38 constitute convenient means for temporarily lifting portions of the secondary seal 14 away from the tank wall 15 for inspection of the primary seal located below the secondary seal (see, for instance, the incorporated McCabe patent). In particular, a lever 21 may be manually grabbed and a force 54 may be applied to that lever in this manner, to move it away from the tank wall 15. The corresponding link 29 thereby acts as a means coupled to the secondary seal 14 at distances greater than zero from the outer circumference 18 at the wall 15 for applying to the secondary seal a lifting force at the first suspension point 35. As seen in FIG. 3, the lifting force is so applied to a curved portion of the seal 14 at a distance from its outer circumference 18. This, as shown by the phantom outline 55 in FIG. 3, sufficiently moves the particular portion of the secondary seal 14 away from the tank wall 15 for a visual inspection 56 of the primary seal or adjacent structural parts of the tank structure.

The subject invention in its preferred embodiment thus provides lifting means including a plurality of levers 21 distributed about and pivoted on the floating roof 12 for a convenient manual lifting of any desired portion of the secondary seal away from the tank wall 15.

The sealing systems according to the subject invention are very reliable in practice, performing well not only in normal operation, but also during exposure to high wind velocities where positive and negative pressures impose particularly strong requirements on the curved seal.

The subject extensive disclosure will suggest or render apparent to those skilled in the art various modifications and variations within the spirit and scope of the subject invention.

We claim:

1. In a method of preventing vapor from escaping from a storage tank through an annular space of varying width between a floating roof in, and a wall of, said tank, the improvement comprising in combination the steps of:

mentioned McCabe and Barbier patents incorporated by reference herein. As shown in these incorporated patents, the primary seal is connected to and encompasses the floating roof and extends to the tank wall 15 in the annular clearance 16 between the floating roof and tank wall.

As mentioned above, the clearance 16 is an annular space of varying width between the floating roof 12 in, and the wall 15 of, the tank 10. The annular space 16 is closed with the corresponding annular flexible seal 14 extending in the tank 10 from the floating roof 12 to an outer circumference 18 at the wall 15 for a width, measured along the seal, larger than the largest extent of the varying width of the annular space 16. As indicated in the above mentioned McCabe patent and elsewhere, the seal 14 may be made of a vapor impervious elastomer. If desired, stiffeners may be embedded in the elastomeric material of the seal 14. However, such reinforcing means may be dispensed with in the practice of the subject invention.

The seal 14 is curved around the floating roof 12 and between such floating roof and the wall 15. To this end, an inner edge portion of the seal 14 is connected to the roof edge flange 13 by a metal band or annulus 19 and bolts 20.

According to a preferred embodiment of the subject invention, a plurality of support bars or levers 21 is provided or distributed about the floating roof 12. The levers 21 are pivoted on the floating roof. To this end, angular brackets 22 are attached to the floating roof by fasteners including the bolts 20.

Each mounting bracket 22 has an aperture accommodating a pivot bolt 23 extending through a pivot aperture in the lower end of the corresponding lever 22.

Nuts 24 and 25 are locked against each other on the threaded portion of the bolt 23 to provide a pivot for the lever 21 relative to the floating roof structure 12.

The levers 21 are thus pivoted for movement of a free end 26 of each lever at and relative to the tank wall 15.

Within the broad scope of the subject invention, the free end 26 of each lever 21 could be provided with one or more rollers riding along the inside of the tank wall 15. However, according to the illustrated preferred embodiment of the subject invention, a bracket or shoe 27 is provided at and attached to the free end 26 of each lever 21 for slidingly engaging the wall 15. In practice, the shoe 27 or similar sliding device is superior to the traditionally employed rollers, in terms of reliability, simplicity and ease of operation in the face of significant contamination of the tank wall by crusts and residues of the stored materials.

The sealing system according to the illustrated preferred embodiment of the subject invention also includes a plurality of links 29 corresponding to the levers 21. There may be one connecting link 29 for each lever 21, as shown in the illustrated embodiment. An upper end of each link 29 is coupled to or pivoted on the lever 21 by a bolt 31 and nuts 32 and 33.

The links 29 are further coupled to the curved seal 14 at first suspension points 35 spaced from the outer circumference 18 at the tank wall 15 by distances greater than zero. To this end, the illustrated preferred embodiment attaches the lower end of each link 29 to the curved seal 14 at the first suspension points 35 with aid of an elevator bolt or flathead fastening device 36. As seen in FIGS. 1 to 3, each suspension point 35 is so located at a curved portion of the seal 14 between the wall 15 and the floating roof 12 at a distance from the circumference 18 of the seal.

In viewing the foreshortened illustration of FIG. 1, it will, of course, be realized that a series of seal suspension devices 38 are in a practical installation distributed about the floating roof structure 12. The devices 38 or equivalent means within the scope of the subject invention apply to the curves seal 14 at intervals spaced about the floating roof 12 a series of forces each acting on the curved seal 14 at a first distance greater than zero from the outer circumference 18 at the wall 15, and at a second distance from the floating roof 12 greater than the first distance just mentioned.

The subject invention thus avoids the above mentioned conventional approach which applied seal retention forces at the outer circumference of the seal, and thereby at a distance practically equal to zero from such outer circumference 18 at the tank wall 15. In avoiding such entrenched prior-art approach, the subject invention provides for a variation of the forces applied to the seal in response to fluctuations of the varying width of the annular space or clearance 16.

In this manner, the subject invention provides for an application of the circumferential seal portion to the tank wall which is optimized for each possible width of the clearance 16. The subject invention thereby avoids especially the drawbacks of prior resilience and spring bias systems which tended to be least effective for the larger width of the clearance 16 and which in some instances could not prevent a flipping or undesired reversal of the seal curvature, as indicated above.

In the illustrated preferred embodiment and equivalent structures according to the subject invention, the curved seal 14 is suspended at the first suspension points 35 from a series of corresponding second suspension points 39 spaced from the first suspension points by third distances. There is, for instance, such a third distance along each link 29 between the bolts 31 and 36.

Each of the second suspension points 39 is spaced from the wall 15 by a fourth distance 41 greater than zero and from a peripheral cylindrical reference surface 42 about the floating roof 12 by a fifth distance 43 greater than the fourth distance 41.

In the operation of the tank structure, the lengths of the fourth and fifth distances 41 and 43 vary in response to fluctuations of the varying width of the annular space 16 between the tank wall 15 and the laterally drifting floating roof 12. According to the illustrated preferred embodiment of the subject invention, the ratio of the fourth width 41 to the fifth width 43 is maintained constant during fluctuations of the varying width of the clearance 16.

This in practice optimizes the support or suspension afforded the curved seal 14 by the system of the subject invention and its embodiments.

FIG. 2 illustrates the operation of any lifting device 38 upon diminution of the width of the annular clearance 16 between the floating roof 12 and the tank wall 15. For instance, the floating roof 12 may be driven on top of the stored liquid by high winds so that the roof advances toward the tank wall 15 from the position shown, for instance, in FIG. 1 to one of the positions shown in FIG. 2. As the floating roof thus advances, the adjacent lever 21 with its shoe 27 at its free end 26 rides up on the tank wall 15 and the seal 14 is correspondingly moved upward. The link 29 coupled to each lever 21 is preferably resilient in nature and configuration, so as to accommodate more readily shape variations of the seal closing said annular space with a corresponding annular flexible seal extending in said tank from said floating roof to an outer circumference at said wall for a width larger than the largest extent of said varying width;

curving said seal around said floating roof and between said floating roof and said wall;

applying to the curved seal at intervals spaced about said floating roof a series of forces each acting on said curved seal at a first distance from said outer circumference at said wall and at a second distance from said floating roof greater than said first distance;

varying said forces in response to fluctuations of said varying width; and reversing said forces by applying a lifting force in response to diminution of said varying width.

2. A method as claimed in claim 1, wherein:

the curved seal is suspended with said forces at said intervals.

3. In a method of preventing vapor from escaping from a storage tank through an annular space of varying width between a floating roof in, and a wall of, said tank, the improvement comprising in combination the steps of:

closing said annular space with a corresponding annular flexible seal extending in said tank from said floating roof to an outer circumference at said wall for a width larger than the largest extent of said varying width;

curving said seal around said floating roof and between said floating roof and said wall;

suspending the curved seal in said tank with a series of suspension devices coupled to said floating roof and riding along said wall; and selectively lifting said suspension devices off said wall in response to diminution of said varying width.

4. A method as claimed in claim 3, including the step of:

coupling said curved seal to said suspension devices at locations spaced from said outer circumference at said wall.

5. A method as claimed in claim 3 or 4, wherein:

said curved seal is flexibly coupled to said suspension devices.

6. Sealing apparatus for preventing vapor from escaping from a storage tank through an annular space of varying width between a floating roof in, and a wall of, said tank, the improvement comprising in combination:

means for closing said annular space including a corresponding annular flexible seal of a width larger than the largest extent of said varying width;

means for curving said seal around said floating roof and between said floating roof and said wall, including means for mounting said seal of larger width on said floating roof to extend in said tank from said floating roof to an outer circumference at said wall; and means for applying to the curved seal at intervals spaced about said floating roof a series of forces each acting on said curved seal at a first distance from said outer circumference at said wall and at a second distance from said floating roof greater than said first distance, said force applying means including means for varying said forces in response to fluctuations of said varying width;

said means for applying forces include means for suspending the curved seal at said intervals; and said means for applying forces include lifting means for reversing the suspension of the curved seal by lifting the suspending means in response to diminution of said varying width.

7. Sealing apparatus for preventing vapor from escaping from a storage tank through an annular space of varying width between a floating roof in, and a wall of, said tank, the improvement comprising in combination:

means for closing said annular space including a corresponding annular flexible seal of a width larger than the largest extent of said varying width;

means for curving said seal around said floating roof and between said floating roof and said wall, including means for mounting said seal of larger width on said floating roof to extend in said tank from said floating roof to an outer circumference at said wall;

means for suspending the curved seal in said tank including a series of suspension devices coupled to said floating roof and riding along said wall; and means coupled to said curved seal for selectively lifting said suspension devices off said wall in response to diminution of said varying width.

8. Apparatus as claimed in claim 7, wherein:

the suspending means and the lifting means are coupled to the curved seal at locations spaced from said outer circumference at said wall.

9. Apparatus as claimed in claim 7 or 8, wherein:

the suspending means and the lifting means include flexible links connected to the curved seal at locations spaced from said outer circumference at said wall.

10. In a method of preventing vapor from escaping from a storage tank through an annular space of varying width between a floating roof in, and a wall of, said tank, the improvement comprising in combination the steps of:

closing said annular space with a corresponding annular flexible seal extending in said tank from said floating roof to a circumference at said wall for a width larger than the largest extent of said varying width;

curving said seal around said floating roof and between said floating roof and said wall;

suspending the curved seal in said tank with a series of suspension devices coupled to said floating roof and riding along said wall; and causing said curved seal to lift said suspension devices off said wall in response to diminution of said varying width.

11. A method as claimed in claim 10, including the steps of:

coupling said seal to said suspension devices at curved portions of said seal at a distance from said circumference at said wall.

12. A method as claimed in claim 10, wherein:

said seal is flexibly coupled to said suspension devices at curved portions of said seal.

13. Sealing apparatus for preventing vapor from escaping from a storage tank through an annular space of varying width between a floating roof in, and a wall of, said tank, the improvement comprising in combination:

means for closing said annular space including a corresponding annular flexible seal of a width larger than the largest extent of said varying width;

means for curving said seal around said floating roof and between said floating roof and said wall, including means for mounting said seal of larger width on said floating roof to extend in said tank from said floating roof to a circumference at said wall;

means for suspending said curved seal in said tank including a series of suspension devices coupled to said floating roof and riding along said wall; and means coupled to the curved seal for causing said curved seal to lift said suspension devices off said wall in response to diminution of said varying width.

14. Apparatus as claimed in claim 13, wherein:

the suspending means and the lifting means are coupled to said seal at curved portions of said seal at a distance from said circumference.

15. Apparatus as claimed in claim 13, wherein:

the suspending means and the lifting means include flexible links connected to said seal at curved portions of said seal at a distance from said circumference.

* * * * *